US008584285B1

(12) United States Patent
Sipherd

(10) Patent No.: US 8,584,285 B1
(45) Date of Patent: Nov. 19, 2013

(54) TRAVEL PILLOW WITH HEAD SUPPORT CONTOURS

(71) Applicant: Ryan Sipherd, Provo, UT (US)

(72) Inventor: Ryan Sipherd, Provo, UT (US)

( * ) Notice: Subject to any disclaimer, the term of this patent is extended or adjusted under 35 U.S.C. 154(b) by 0 days.

(21) Appl. No.: 13/683,390

(22) Filed: Nov. 21, 2012

(51) Int. Cl.
*A61G 9/00* (2006.01)

(52) U.S. Cl.
USPC ..... 5/640; 5/636

(58) Field of Classification Search
USPC ..... 5/630, 644, 636–640
See application file for complete search history.

(56) References Cited

U.S. PATENT DOCUMENTS 5,948,013 A * 9/1999 Swezey et al. ..... 607/108
7,213,883 B2 * 5/2007 Charnitski ..... 297/391
7,669,265 B2 * 3/2010 Weise ..... 5/640

* cited by examiner

*Primary Examiner* — Fredrick Conley
(74) *Attorney, Agent, or Firm* — J. Todd Rushton

(57) ABSTRACT

The present invention is a travel pillow that provides head cushioning, lateral support and stays in place when the user is in a seated position or semi-reclined. The travel pillow including a neck support cradle, head base contour to provide vertical head support, head support platform, side buttresses to provide lateral head support and support bases to achieve an anatomically neutral position for the cervical spine.

12 Claims, 5 Drawing Sheets

TRAVEL PILLOW WITH HEAD SUPPORT CONTOURS

BACKGROUND

The present invention relates to support cushions or pillows and more specifically to the field of support cushions used for travelling when seated up-right or in a semi-reclined position.

In the competitive marketplace of commercial carriers, the niceties and services continue to diminish and the space provided for a traveler continues to shrink; it is now imperative that the traveler prepare for his own comfort during an extended transit. This applies equally to airline and over-the-road carriers. Passenger comfort is also a concern when traveling in private automobiles, a sleeping child contributes to parental bliss during a long trip, while an uncomfortable child can make a trip nearly unbearable for everyone in the car.

The single most important factor for a comfortable and enjoyable long drive or flight is the ability to sleep for at least a portion of the time. This is especially true on flights, such as San Francisco to Tokyo or New York to Kiev where the flight will be in the air between 10 and 12 hours non-stop.

Another recent phenomenon that has occurred in the world of travel is the "red-eye" flight or over-night bus trip. As the price of travel continues to increase, savvy passengers have found that flying or travelling during off-peak hours is significantly less expensive. A business traveler may book a mid-night Sunday flight cross-country to arrive at work on Monday morning, in this case sleeping throughout the course of the flight is the only way this type of schedule is possible.

People attempting to find comfortable pillows for travel explains the myriad of travel pillows available in airport convenience stores, through in-flight magazines, retailers and online. Many travel pillows are simple rectangular pillows, inflatable pillows or the ubiquitous "horseshoe" that fits around the traveler's neck. Simple rectangular pillows and inflatable pillows are difficult to keep in place and do little to support the head when seated. The horseshoe shaped pillow provides a cushion between the seatback and the neck and restricts the user's head from falling completely onto his or her shoulder; however, this device provides little lateral support, does not cushion the user's head and provides no vertical support for the neck. When the user's head is allowed to rest with the neck craned or cervical spine in a non-aligned position there is a strong possibility that the user will awake with a sore or "kinked" neck.

Some devices have attempted to address the limitations of the conventional pillow or cushions, like CONTOURED TRAVEL PILLOW, U.S. Pat. No. 4,031,578 to Sweeney, filed May 20, 1976 or the TRAVEL PILLOW, U.S. Pat. No. 6,010,192 to King, filed Jul. 29, 1998. Each of these devices provides cushioning and some lateral support, but omit any support for the vertical component. Yet another device, TRAVEL PILLOW PROVIDING HEAD AND NECK ALIGNMENT DURING USE, U.S. patent application Ser. No. 12/831,829 to Tansingco, filed Oct. 22, 2009 does provide some lateral neck support and vertical support it does not provide any cushioning for the back of the user's head.

What is needed is a travel support cushion or pillow that provides ample lateral support, vertical support and cushioning for the user's head.

SUMMARY OF THE INVENTION

The present invention is a travel pillow that provides head cushioning, provides excellent lateral support and stays in place when the user is in a seated position.

One embodiment of the present invention or travel pillow with head support contours includes top portion having a headrest configured to receive and support the back portion of the user's head, a neck support portion and two lateral side buttresses. When the user's head is properly placed on the headrest portion, the neck support wraps around the user's neck and engages the base of the user's head. This engagement between the neck support and the head ensures that the travel pillow of the present invention will stay in place even when the user is in a seated or semi-reclined position. A bottom portion of the travel pillow includes lateral bases that service to elevate the travel pillow into proper height where the user's head can be supported in an anatomically neutral position to preserve cervical spine alignment. The lateral bases support the headrest portion and neck support at the free ends with an unsupported space underneath. When a user's head is placed on the headrest portion and engages the neck support, the weight of the head and resulting force causes the headrest and neck support to deflect or bend downward, this deflection creates improved cushioning effect, and causes the lateral buttresses to roll in toward the user's head creating a secure head cradle. The lateral bases have a contoured bottom to allow unrestricted rotation of the lateral buttresses.

In one embodiment of the present invention the travel pillow is comprised of one of open cell foam or closed cell foam having the density required to give proper support and proper deflection of the lateral buttresses. In another embodiment of the present invention the travel pillow is comprised of heat sensitive memory foam as commonly known in the art. The foam may be molded, cut, ground or skived to shape. The foam embodiment may be used as formed, may be covered with a material slip cover, or may include a simulated material cover or texture that is foamed in place during initial manufacturing. In other embodiments the travel pillow may be inflatable or may be self inflating having an open cell foam body and an air tight material outer shell. In other embodiments the travel pillow may be formed using traditional fabric or sheet material construction and stuffed with a synthetic polyester, polystyrene or natural batting material such as cotton, feather down, or buckwheat hulls.

BRIEF DESCRIPTION OF THE DRAWINGS

The following description of the embodiments can be understood in light of the Figures, which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals in different drawings represent the same element, and thus their descriptions may be omitted.

DETAILED DESCRIPTION OF THE DRAWINGS

Figure 1:
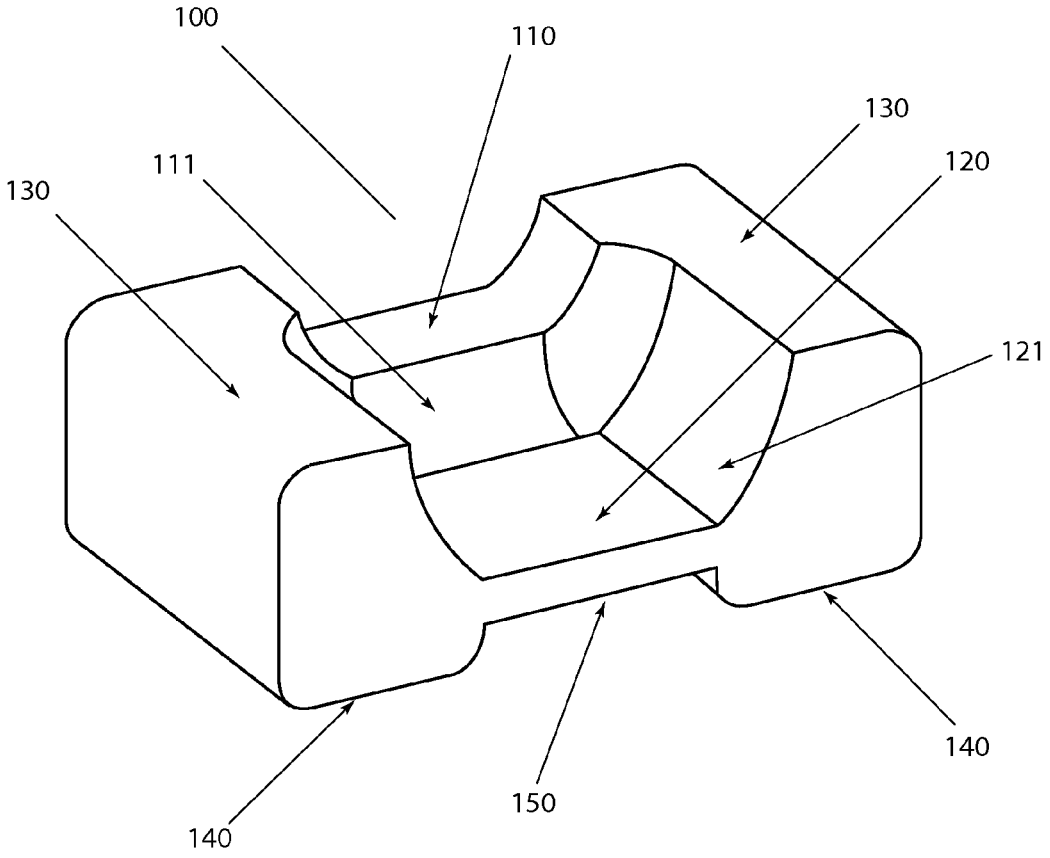
FIG. 1 is a perspective view of a travel pillow with head support contours.

For the purposes of promoting an understanding of the principles in accordance with the disclosure, reference will be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure.

As used in this specification and the appended claims, the singular forms "a," "an," and "the" include plural referents unless the context clearly dictates otherwise. In describing and claiming the present disclosure, the following terminology will be used in accordance with definitions set out below. As used herein, the terms "comprising," "including," "containing," "characterized by," and the grammatical equivalents thereof are inclusive or open-ended terms that do not exclude additional, unrecited elements or method processes.

Figure 2:
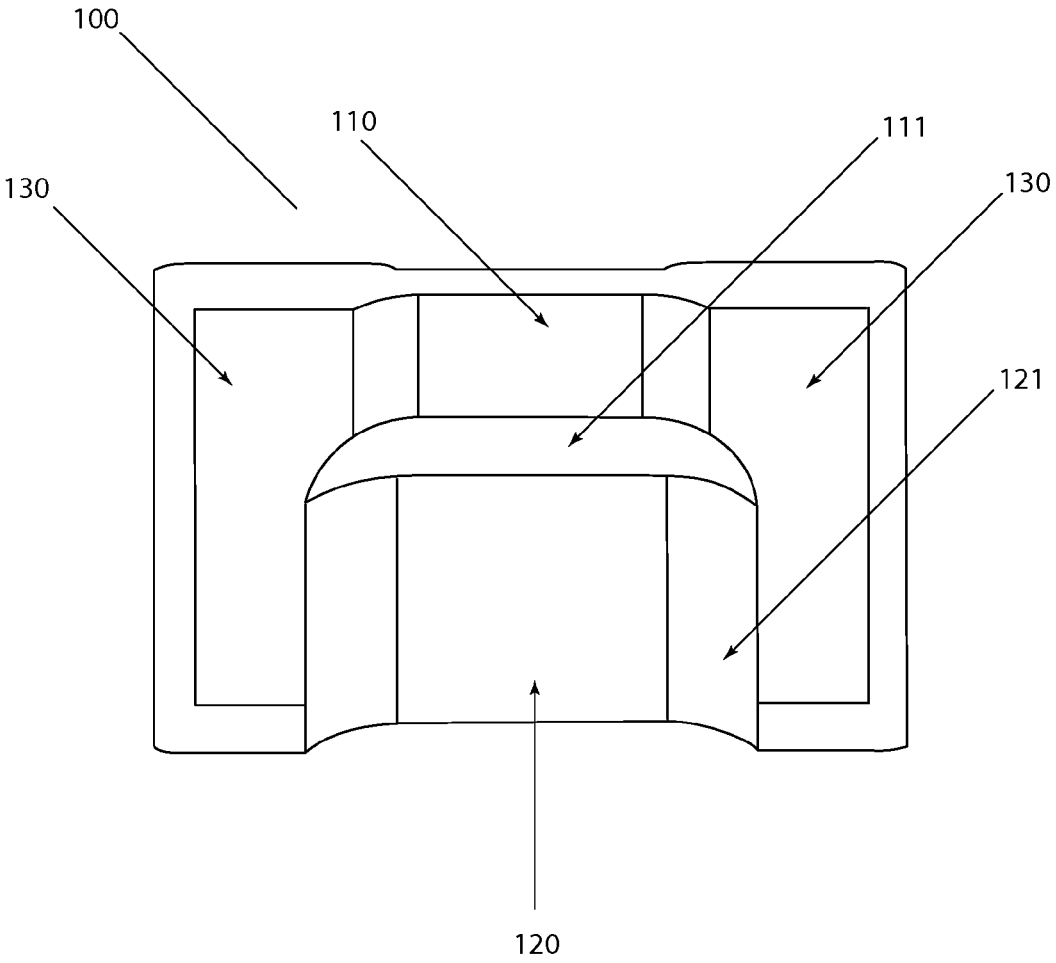
FIG. 2 is a top view of a travel pillow with head support contours.
Figure 3:
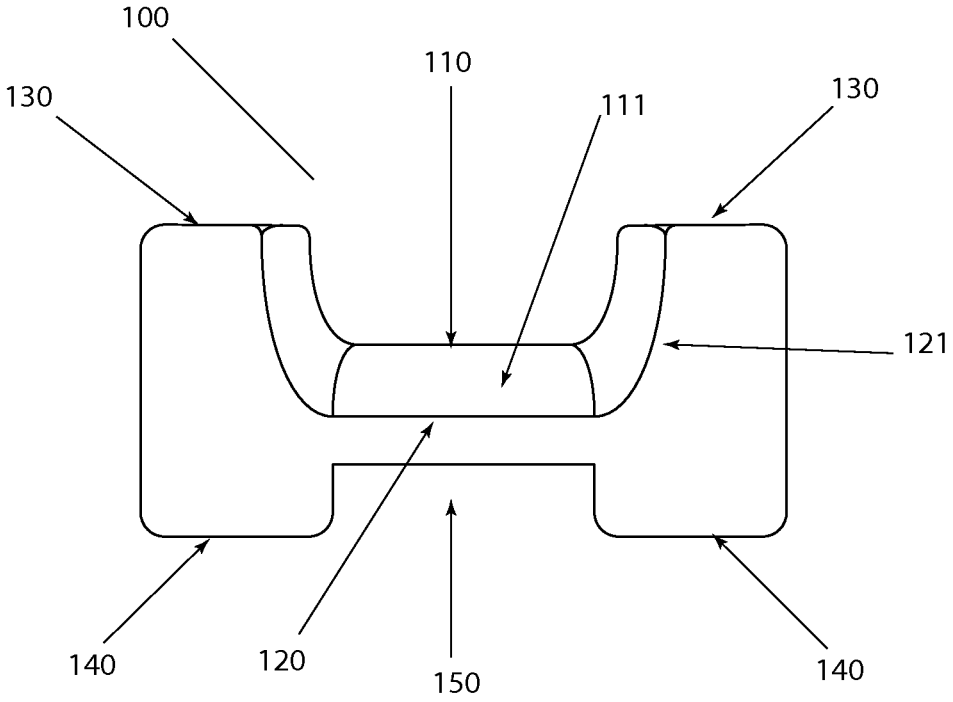
FIG. 3 is a front view of a travel pillow with head support contours.

Shown in FIGS. 1 through 3 is one embodiment of the present invention or travel pillow with head support contours 100. Travel pillow 100 includes a neck support cradle 110 with head base contour 111, a head support 120, side buttresses 130 and support bases 140. Head support side cradle 121 is contoured into the inside vertical side of each side buttress 130. A deflection relief 150 is created in the space between the bottom of the head support 120, the neck support cradle 110 and the support bases 140. As shown, support bases 140 are substantially flat to provide a stabile base for travel pillow 100, however, it is contemplated that the support bases 140 may be rounded or tapered to facilitate or accommodate deflection of the side buttresses 130.

Figure 4:
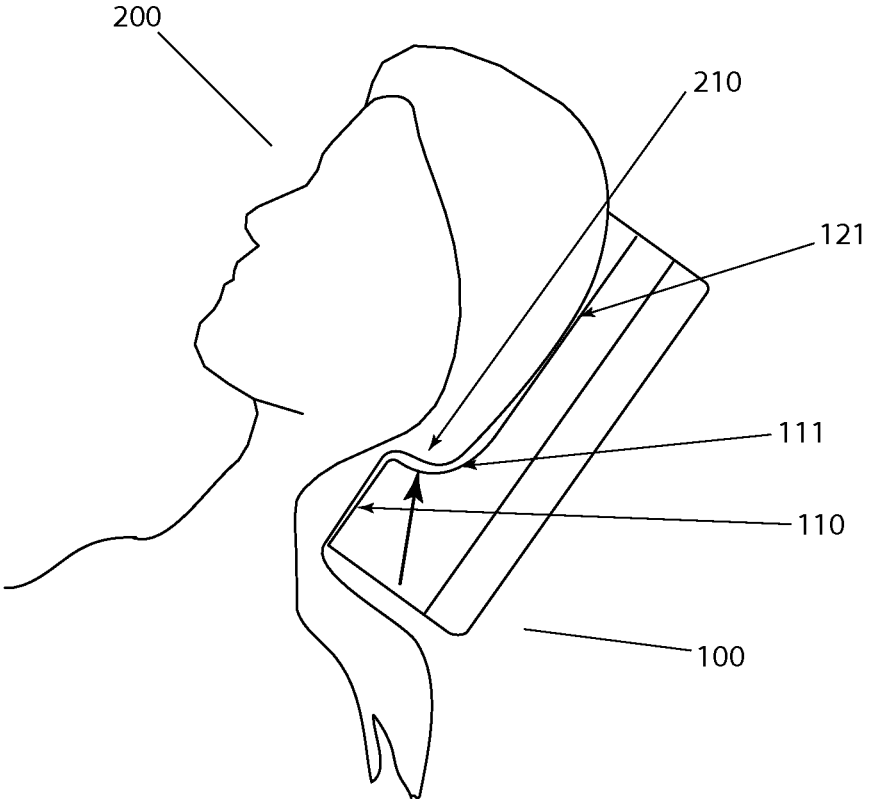
FIG. 4 is a section view of a travel pillow with head support contours and engagement with the user, and, FIG. 5 is a front view of a travel pillow with head support contours in use by the user.

FIG. 4 shows a user 200 in semi-reclined position with travel pillow 100 under her head. The back of the head rests against the head support 121, with the base of the head engaged in the head base contour 111 and the neck supported by the neck support cradle 110. The head base contour 111 provides vertical support of the user's 200 head and in conjunction with the neck support cradle 110 prevents the travel pillow 100 from moving or sliding down when used in a seated or reclined position.

Figure 5:
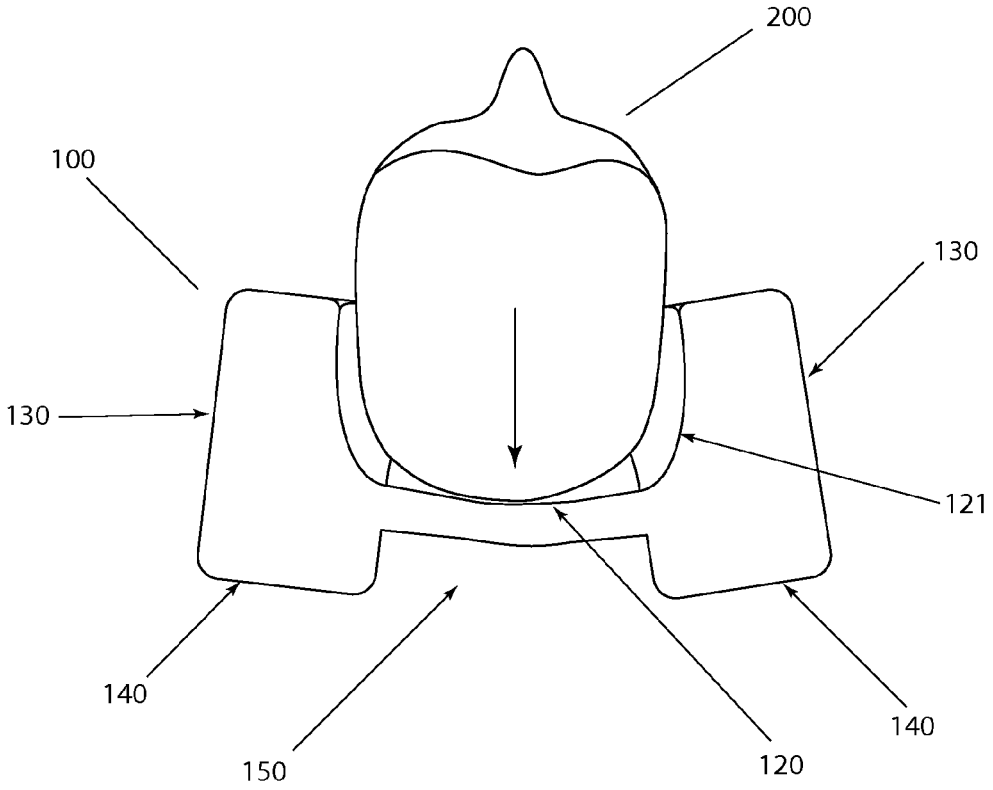

Shown in FIG. 5 is a top view of user 200 with her head resting on travel pillow 100. When pressure is applied to the neck support cradle 110 and the head support 120, each of the areas bend downward into the deflection relief 150, the bending or deflection of the head support 120 and neck support cradle 110 cause the side buttresses 130 to pivot inward and the head support side cradles 121 to engage the side of the user's head. This engagement provides lateral support and prevents the user's head from falling or rolling to the side after drifting off to sleep.

In view of the foregoing, those having ordinary skill in the relevant art will appreciate the advantages provided by the features of the present disclosure. It is to be understood that the above mentioned arrangements are only illustrative of the application of the principles of the present disclosure. Numerous modifications or alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. A travel pillow comprising;
a head rest platform,
a neck support cradle,
head support buttresses,
support bases,
the neck support cradle having a front surface, a back surface and a top surface, the top surface formed as an arcuate structure that engages the center of the user's neck at the spine and extends up to the mid-line on both sides of the users neck,
the head rest platform forming a rectangle, having a top edge, a bottom edge and two side edges, the neck support cradle attached to the head rest platform at the bottom edge of the head rest platform, the bottom edge of the head rest platform and the back surface of neck support cradle forming a right angle, and the two side edges of the head rest platform and the neck support cradle attached to the head support buttresses and the support bases,
the support bases suspending the head rest platform and the neck support cradle creating a deflection relief,
the neck support cradle including a head base contour on the front surface, the head base contour formed as a concave depression that extends from the head rest platform to a front edge of the top surface of the neck support cradle, the head base contour supporting the user's head vertically when the user is in a seated or semi-reclined position, and,
deflection of the head rest platform and neck support cradle causing the head support buttresses to roll inward to support the user's head laterally.

2. The travel pillow of claim 1 wherein the travel pillow is comprised of one of, open cell foam, closed cell foam and memory foam.

3. The travel pillow of claim 2 including a material slip cover.

4. The travel pillow of claim 2 wherein a material cover is formed in place.

5. The travel pillow of claim 1 wherein the travel pillow is inflatable.

6. The travel pillow of claim 1 wherein the travel pillow is self-inflating.

7. The travel pillow of claim 6 comprising;
an open cell foam core,
an air-tight envelope, and,
an air valve assembly.

8. The travel pillow of claim 1 wherein the travel pillow includes a material envelope filled with batting.

9. The travel pillow of claim 8 wherein the batting is one of, polyester, polystyrene, cotton, feather down, and buck wheat hulls.

10. The travel pillow of claim 1 wherein the support bases have a tapered bottom to facilitate the inward movement of the head support buttresses.

11. The travel pillow of claim 1 wherein the support bases have a rounded bottom to facilitate the inward movement of the head support buttresses.

12. The travel pillow of claim 1 wherein the height of the support bases allow the user's cervical spine to achieve an anatomically neutral position.

* * * * *